US006715175B2

(12) United States Patent
Ciancimino et al.

(10) Patent No.: US 6,715,175 B2
(45) Date of Patent: Apr. 6, 2004

(54) LOAD UNBALANCED PREDICTION METHOD AND APPARATUS IN AN APPLIANCE

(75) Inventors: Rosario Ciancimino, St. Joseph, MI (US); Brenner Martin Sharp, Bridgman, MI (US); Gerald C. Stenger, Mill Creek, IN (US)

(73) Assignee: Whirlpool Corporation, Benton Harber, MI (US)

( * ) Notice: Subject to any disclaimer, the term of this patent is extended or adjusted under 35 U.S.C. 154(b) by 218 days.

(21) Appl. No.: 09/885,842

(22) Filed: Jun. 20, 2001

(65) Prior Publication Data

US 2002/0035757 A1 Mar. 28, 2002

Related U.S. Application Data

(60) Provisional application No. 60/214,209, filed on Jun. 26, 2000.

(51) Int. Cl.[7] ..... D06F 33/02

(52) U.S. Cl. ..... 8/159; 68/12.06; 68/12.27

(58) Field of Search ..... 8/159; 68/12.06, 68/12.27

(56) References Cited

U.S. PATENT DOCUMENTS

| | | | | |
|---|---|---|---|---|
| 4,765,161 A | | 8/1988 | Williamson | 68/12 R |
| 5,070,565 A | | 12/1991 | Sood et al. | 8/159 |
| 6,282,965 B1 | * | 9/2001 | French et al. | 73/660 |
| 6,381,791 B1 | * | 5/2002 | French et al. | 8/159 |
| 6,393,918 B2 | * | 5/2002 | French et al. | 73/660 |
| 6,418,581 B1 | * | 7/2002 | Bruce et al. | 8/159 |
| 6,442,979 B1 | * | 9/2002 | Thorn et al. | 68/12.16 |
| 2002/0016997 A1 | * | 2/2002 | Jonsson | 8/159 |
| 2003/0056302 A1 | * | 3/2003 | Broker et al. | 8/159 |

FOREIGN PATENT DOCUMENTS

| | | | |
|---|---|---|---|
| EP | 0969133 | 1/1920 | D06F/37/20 |
| EP | 0071308 | 5/1985 | D06F/37/30 |
| EP | 0394177 | 4/1990 | D06F/37/20 |
| EP | 0313339 | 12/1994 | D06F/37/20 |

* cited by examiner

*Primary Examiner*—Frankie L. Stinson
*Assistant Examiner*—Joseph L. Perrin
(74) *Attorney, Agent, or Firm*—Thomas J. Roth; Robert O. Rice; John F. Colligan

(57) ABSTRACT

A method and apparatus for predicting load unbalance in an appliance is provided for an appliance having a vessel configured to receive a supply of material and rotatable about an axis. A control is arranged and configured to rapidly accelerate a rotation of the vessel, determine an amount of energy with which the vessel has engaged the relatively stationary part, compare the amount of energy with a predetermined value and send a signal indicative of an unbalance condition if the amount of energy exceeds the predetermined value. The vessel may be rotated by use of an electric motor such as a controlled induction motor and the control can be used to measure the electric current drawn by the motor and through manipulation of the current, determine the amount of energy with which the vessel engages the stationary part of the appliance.

18 Claims, 4 Drawing Sheets

LOAD UNBALANCED PREDICTION METHOD AND APPARATUS IN AN APPLIANCE

This application claims benefit of provisional application 60/214,209 filed Jun. 26, 2000

BACKGROUND OF THE INVENTION

The present invention relates to a method and apparatus for predicting the unbalance condition of a load of material in an appliance and more particularly, for predicting an unbalance condition of a load of material in a rotatable vessel of the appliance.

Various appliances, such as automatic washing machines, automatic dryers, centrifugal liquid extractors, etc., utilize a rotating tub, basket or other vessel holding a load of material which may or may not be evenly distributed within the vessel. The condition of having the load unevenly distributed, or out of balance, creates a situation where the center of mass of the rotating vessel does not correspond to the geometric axis of the vessel. This leads to the generation of high loads and severe vibration of the vessel. In an appliance, this severe vibration may cause the phenomenon of movement of the appliance across the floor or other supporting surface. This can occur both in vertical axis rotating vessels as well as horizontal axis vessels and also in those appliances where the axis is arranged in between vertical and horizontal.

Various attempts have been provided in the prior art to provide mechanical arrangements to limit or reduce the possibility of unbalanced loads, which typically involve the addition of various masses, either fixed or movable, to the vessel which requires additional power for the motor to rotate the vessel.

Approaches have also been disclosed in the prior art for detecting a load imbalance, for example, in an inverter driven motor for a washing machine, as disclosed in U.S. Pat. No. 5,070,565. That patent discloses to examine a ripple in the dc-inverter bus current, with a ripple value above a predetermined level being indicative of load unbalance. If a load unbalance is detected, the washer controller would resume a redistribution cycle to attempt to re-balance the clothes. This would be attempted a predetermined number of times and, if the load is still unbalanced, the spin cycle would be aborted. If the ripple value falls below the predetermined level before the maximum number of tries is reached, the spin cycle is started. Once a spin cycle has been initiated, the length of the spin cycle is determined on the basis of the magnitude of any remaining load unbalance. Spin rate and spin time may be adjusted based upon the degree of load unbalance detected.

It would be an advance if a method and apparatus were provided in which the potential for a severe unbalance could be predicted in advance of it actually occurring so that appropriate steps could be taken to avoid the detrimental effects of such a condition.

SUMMARY OF THE INVENTION

The present invention provides a method and apparatus for predicting, at a relatively low rotational speed, a severe unbalance condition in a rotating device such as a basket, tub or other rotatable vessel of an appliance, for example an automatic washer. The method and apparatus provide the prediction by monitoring the motor current signature. When the amount of unbalance is estimated at a low rotational speed, the cycle can attempt a redistribution routine in order to eliminate the unbalance condition before it becomes a problem. If unbalance still persists, the spin speed can be adaptably limited or the cycle can be terminated and the user can be advised.

The effect of unbalanced loads in a motor driven rotating component, such as a rotatable vessel, translates into motor torque oscillations, which are proportional to the motor stator currents. Moreover, increased vibrations in certain appliances cause energy dissipation in passive components, such as in the suspension system, causing the average motor current to increase. In the case of a controlled induction motor (CIM), the stator currents are estimated by directly measuring the dc bus current of the inverter.

In the present invention, motor torque oscillations are monitored at low speed and a severe unbalance condition is predicted before it develops into a problem condition.

A special speed profile is commanded to the motor by the control system in order to obtain information about the load. When a steep acceleration is applied at low speed, such as an increase from 60 rpm to 100 rpm in approximately 1 second, the presence of large unbalances in the vessel makes the vessel hit the cabinet, causing perturbations ("bumps") in the motor torque and current. It has been observed experimentally that these perturbations are proportional to the amount of unbalanced load present in the vessel and relate to the extremely unbalanced vibrational behavior of the appliance at higher rotational speeds.

The apparatus may be arranged and selected such that the vessel itself is not striking the cabinet, however, some component which moves with the vessel should preferably engage with some component which is relatively stationary as compared to the cabinet. In this manner movement of the vessel relative to the cabinet (other than rotational) can be detected and measured. Thus, as used herein, and including in the claims, the concept of the vessel striking the cabinet is intended to include such vessel components engaging such cabinet components.

A faster motor frequency and a slower bump frequency characterize the current signature. More accurately, the motor current has three components, two of which are harmonic. A first component is the nominal motor current. The second component is the frequency that is input into the motor to determine its fundamental speed. The third component is created by the motor when it responds with increases in motor torque that are required to overcome the gyroscopic effects of the vessel striking the cabinet as the motor tries to maintain constant speed. Nominal motor current and motor frequency go into the motor which sets the motor running at a constant speed. When the vessel hits the cabinet it tries to slow the vessel down, and the motor increases torque to prevent this from happening. What results is the sum of nominal motor current, the motor frequency and the frequency with which the vessel strikes the cabinet. In order to extract the unbalance information, the motor frequency is digitally filtered out with a running average algorithm. This leaves the bump frequency component and the nominal motor current. The bump frequency is then filtered out, leaving a nominal motor current curve. The difference between the nominal motor current curve and the curve with the bump frequency is integrated to obtain a measure of the energy used by the motor to maintain constant speed when the vessel strikes the cabinet. This is termed bump energy. The bump energy is accumulated for a fixed amount of time, for example a few seconds, and is then compared to a threshold in order to determine whether a higher rate spin cycle should proceed or whether some corrective action should be taken.

DETAILED DESCRIPTION OF THE PREFERRED EMBODIMENTS

The present invention relates to a method and apparatus for determining an out of balance condition in a rotating vessel and has applicability in a wide variety of devices in which materials are placed into a rotatable vessel, which materials may be subject to an unbalanced distribution within the vessel.

For purposes of providing an explanation of the invention in a preferred embodiment, an automatic clothes washer has been identified as an appliance within which the invention can be utilized. It should be understood that the invention can be utilized not only in a vertical axis washer as illustrated, but also horizontal or tilted axis washers, clothes dryers, centrifugal extractors and separators, and other appliances and devices in which a rotatable vessel carries a material therein, which material is subject to being arranged in an unbalanced condition.

Figure 1:
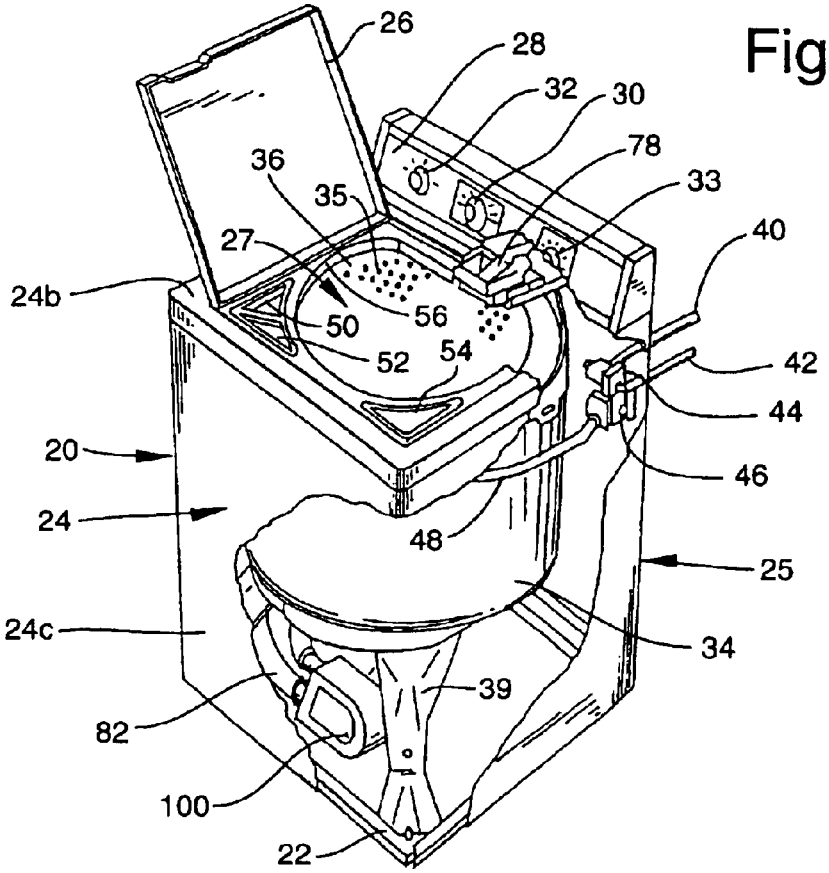
FIG. 1 is a perspective view of an automatic washer in which the present invention could be utilized.

FIG. 1 there is illustrated at 20 generally a washing machine of the automatic type, i.e., a machine having a pre-settable sequential control apparatus for operating a washer through a pre-selected program of automatic washing, rinsing and drying operations in which the present invention may be embodied. Machine 20 includes a frame 22 carrying vertical panels 24 forming the sides 24*a*, top 24*b*, front 24*c* and back 24*d* of the cabinet 25 for the washing machine 20. A hinged lid 26 is provided in the usual manner to provide access to the interior or treatment zone 27 of the washing machine 20. The washing machine 20 has a console 28 including a timer dial 30 or other timing mechanism and a temperature selector 32 as well as a cycle selector 33 and other selectors as desired.

Internally of the machine 20 described herein by way of exemplification, there is disposed an imperforate fluid containing tub 34 within which there is a spin wash basket 36 with perforations or holes 35 therein, while a pump 38 is provided below the tub 34. The spin basket 36 defines a wash chamber and includes an inside wall surface extending upwardly from a substantially flat bottom. A motor 100 is operatively connected to the basket 36 through a transmission to rotate the basket 36 relative to the stationary tub 34. All of the components inside the cabinet 25 are supported by struts 39 and there may also be provided various passive elements such as shock absorbers or springs to absorb vibrations and movements of the basket and tub relative to the frame and cabinet of the washing machine 20. The basket 36 comprises a vessel into which materials such as a fabric load may be charged.

During the course of operation of an appliance such as an automatic washer, the wash basket 36 is rotated at relatively high speeds in order to extract water or other wash liquids from the clothes load. If the clothes load is not evenly distributed within the wash basket, an unbalance condition occurs which will cause the rotating basket to oscillate around the axis of rotation. Hence, there will be some movement of the basket in a direction perpendicular to the axis of rotation. Depending upon the degree of unbalance and the speed of rotation, the oscillation may be small or it may be large enough to actually cause the basket 36 (and tub) 34 to engage the washer cabinet 25 or some other relatively stationary component of the appliance with some level of force. Continued operation in such a mode could cause severe damage to the washer and could cause the entire appliance to move from its otherwise stationary location, which could cause other damage or possibly hazardous conditions in the proximity of the appliance.

The effect of unbalanced loads also causes motor torque oscillations which are proportional to the motor stator currents. Also, increased vibrations cause energy dissipation in passive components of the suspension system, in turn, causing the average motor current to increase. In a motor such as a controlled induction motor, the stator currents are estimated by directly measuring the dc-bus current of the inverter.

The present invention provides a method and apparatus for predicting an unbalance condition in a rotatable vessel prior to a severe unbalance condition occurring.

As mentioned, typically an unbalanced condition becomes more severe as rotation speed increases. However, in order to predict an unbalance condition, a steep or rapid acceleration is applied to the rotating vessel when it is rotating about an axis at a relatively low speed such as 60 rpm and the acceleration is up to a somewhat higher, but still low speed, such as 150 rpm. This acceleration should occur rapidly, for example, in about 1 second. When this steep acceleration is applied even at a low rotational speed, the presence of large unbalances in the vessel enhances the chances for the vessels to hit its surrounding cabinet causing perturbations or bumps in the motor torque and current. Applicants have observed that these perturbations are proportional to the amount of unbalanced load present in the drum and relate to the extremely unbalanced vibrational behavior of the washer at higher rotational speeds. These hits, at low rotational speeds, do not have enough energy to cause the appliance to move or become damaged. While the particular speeds and acceleration rates may change or vary depending on the physical attributes of the particular appliance involved, what is important is that the appliance is accelerated up through a vibrational mode, which can be determined experimentally, where the rotating vessel wobbles on its axis, which could cause it to strike the cabinet. The high or rapid acceleration through this frequency zone of the system will excite the natural frequency of the system, exaggerating the vibrations and causing cabinet strikes, which can be measured.

Figure 2:
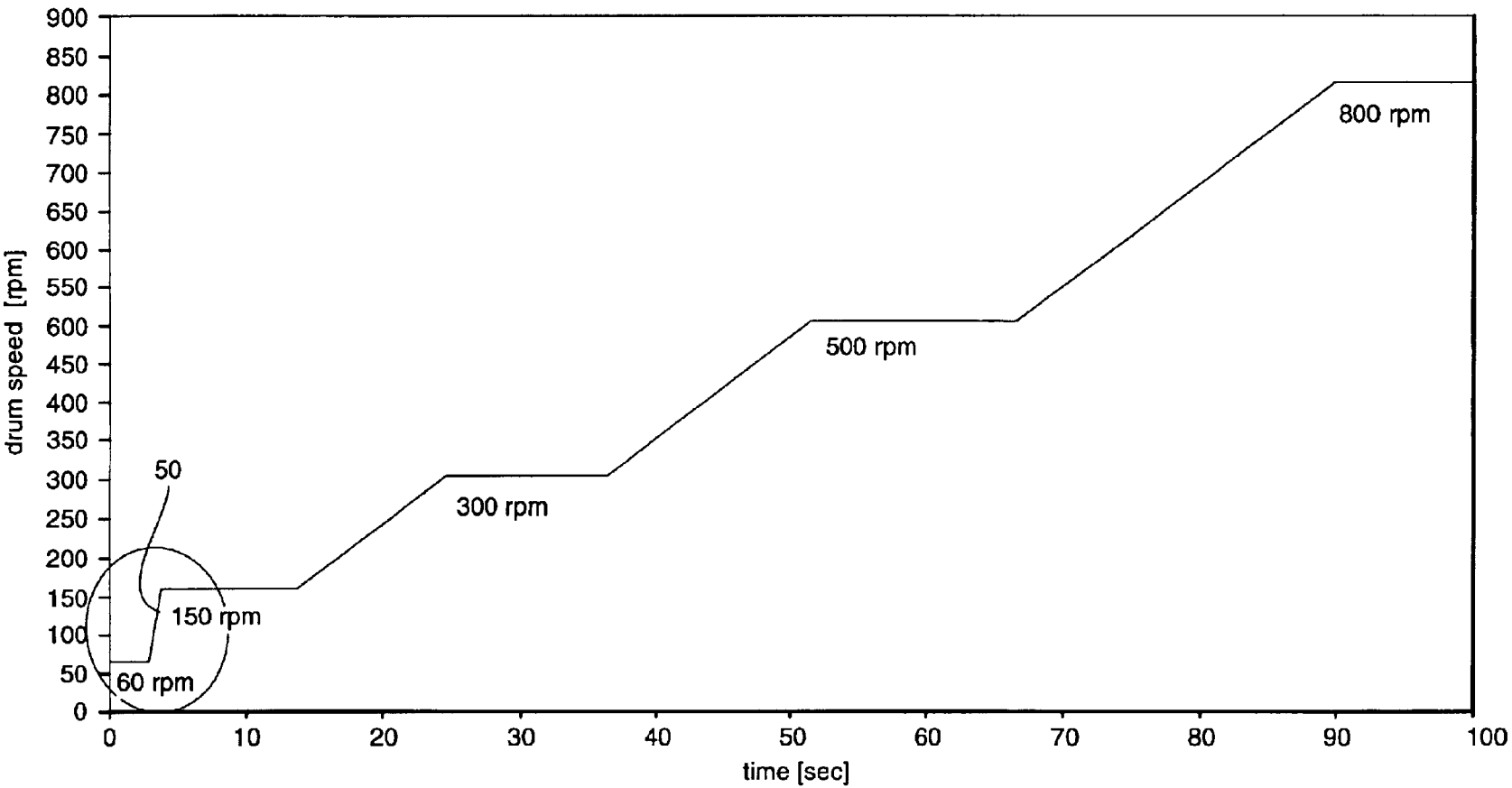
FIG. 2 is a graphic illustration of rotational vessel speed.

FIG. 2 illustrates graphically a spin profile showing rotational speed over time. A rapid acceleration phase is shown at 50 which represents a rapid rise in rotational speed from a relatively low speed, such as 60 rpm, to a somewhat higher speed, such as 150 rpm. Typically, in an automatic washer, the speeds are more gradually ramped up to higher and higher levels such as 300 rpm, 500 rpm and 800 rpm as a final rotational speed.

Figure 3:
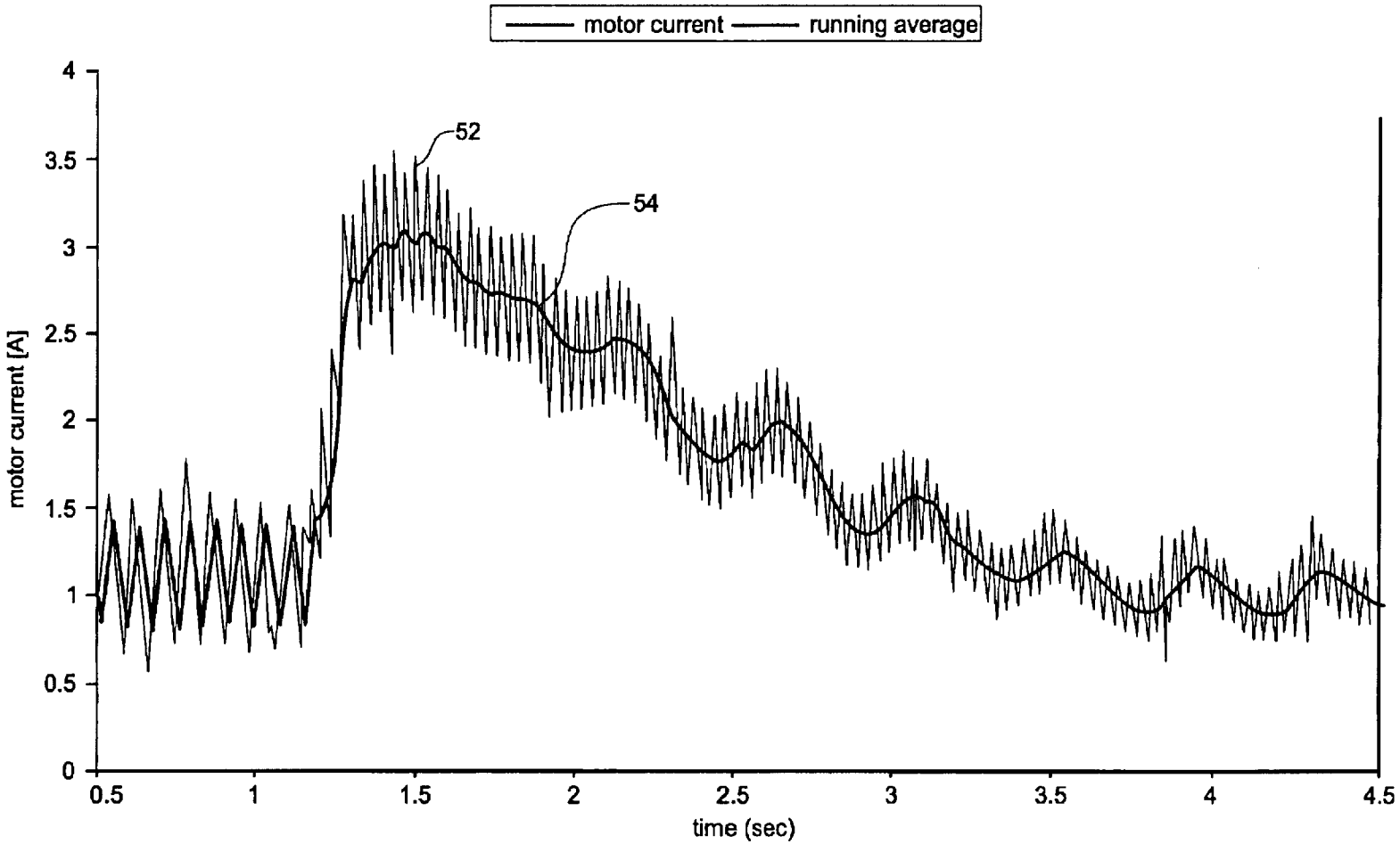
FIG. 3 is a graphic illustration of motor current required to rotate the vessel.

FIG. 3 illustrates measured motor current during the rapid acceleration mode and shortly thereafter. The actual motor current is illustrated at 52 and comprises a relatively high frequency curve. By sensing the motor current it can be determined whether the vessel is engaging the relatively stationary cabinet in that a bump frequency forms a component of the motor current. The bump frequency appears as a lower frequency represented by a running average of the motor current and is shown at 54 in a heavier line. In practice, the faster motor frequency can be digitally filtered out with a running average algorithm to leave the running average or bump frequency.

Figure 4:
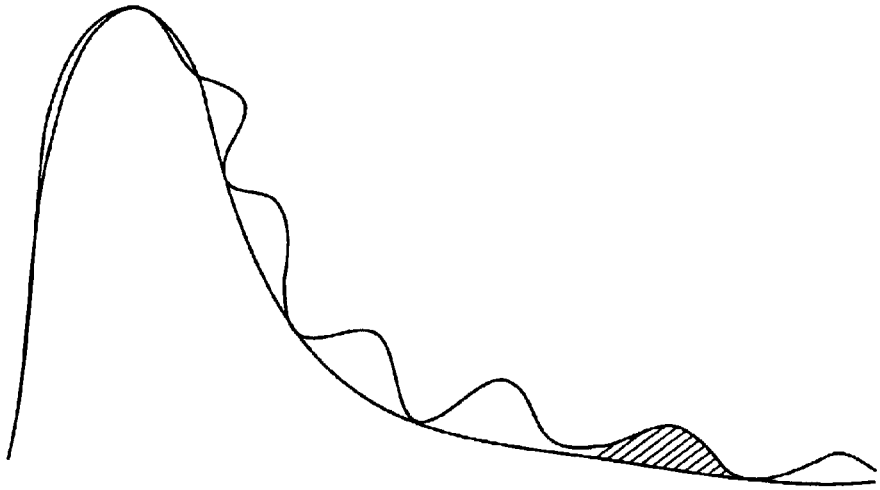
FIG. 4 is a schematic illustration of an approach to determine bump energy between the rotating vessel and cabinet.

FIG. 4 illustrates a comparison of the bump frequency curve with a reference curve which represents the average motor current in a balanced load. The areas enclosed by the bumps in the bump frequency curve represent the amount of energy with which the tub has hit the washer cabinet. This area can be calculated using standard integration techniques and the bump energy can be accumulated for a fixed amount of time, for example, about four seconds, and can then be compared to a threshold energy level in order to determine whether the spin cycle should proceed toward a higher speed or whether an out of balance signal should be generated by the control.

The precise initial speed rate of acceleration and speed after acceleration may be varied, depending on the particular appliance involved, the size or mass of the typical load of material that the vessel is charged with, the severity of unbalance that may be expected, typical final rotational speeds for the vessel, and other parameters known to those skilled in the art. What is important is that the initial rotational speed, acceleration rate, and rotational speed after acceleration be chosen so that the speeds are not so high as to cause damage to the appliance or damage to the user if an unbalance condition exists. Also, an acceleration rate should be chosen that is sufficiently rapid so as to excite the mechanical system of the appliance to show the effects of an unbalance condition. This showing could occur such as by causing the rotating vessel, or some movable component moved by the vessel to engage a relatively stationary component of the appliance so that the energy of the engagement can be measured and compared against a predetermined value.

If an out of balance signal is generated, this could lead to various further steps including an attempt, by the machine, to redistribute the load such as by means of mechanical agitation or tumbling and then a re-testing to predict whether an unbalanced load still exists. This process can be repeated for a predetermined of retries, after which the user can be advised by an appropriate visible or audible signal and the cycle stopped until the user manually redistributes the material load and resets the control.

Also, when the appliance is operated at a low speed and a severe unbalance condition is predicted to occur at higher spin speeds not yet achieved, the ultimate spin speed can be adaptively dropped down by the control to a safe level, in which the machine vibrations and mechanical stresses are tolerable. Thus, the spin speed would not initially proceed to the predetermined ultimate spin speed. The controller can continuously monitor the system energy dissipation so that, as water gets extracted from the clothes and the load gets lighter, the spin speed can gradually be increased up to the maximum desired value.

Alternatively, if an unbalance condition is detected and predicted, the unbalance signal can immediately terminate further operation of the appliance or device until the load is redistributed.

Figure 5:
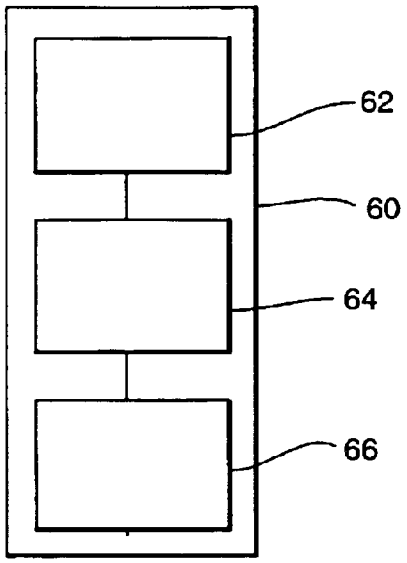
FIG. 5 is a schematic illustration of an appliance embodying the present invention.

Thus, the present invention provides an apparatus as shown schematically in FIG. 5 in which there is an appliance 60 which comprises a vessel 62 mounted for rotation about an axis and configured to receive a supply of material and arranged relative to a relatively stationary part of the appliance 60 whereby the vessel 62 will engage the relatively stationary part in a severe unbalance loading condition of the material in the vessel while the vessel is rotating.

The vessel is caused to rotate by a motor 64 which is operatively connected to the vessel to rotate the vessel.

A control 66 is operably connected to the motor 64 and is arranged and configured to rapidly accelerate a rotation of the vessel through operation of the motor. The control is also configured to determine an amount of energy with which the vessel engages the relatively stationary part of the appliance, preferably as reflected by a characteristic of electrical current drawn by the motor. The control is also configured to compare the amount of energy with a predetermined value and to send a signal indicative of an unbalance condition if the amount of energy exceeds the predetermined value. The signal can be used to modify or control a future operation of the machine such as by effecting a redistribution mode, terminating operation of the motor and/or generating a visible or audible signal for a user of the appliance. As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. In an appliance with a relatively stationary component and a rotatable vessel for holding a supply of material, a method comprising:

charging said vessel with said supply of material;

rotating said vessel about an axis;

rapidly accelerating said rotation of said vessel;

determining an amount of energy with which said vessel has engaged said relatively stationary part following a start of said rapid acceleration;

comparing said amount of energy with a predetermined value; and sending a signal indicative of an unbalance condition if said amount of energy exceeds said predetermined value.

2. The method of claim 1, wherein said appliance is an automatic washing machine.

3. The method of claim 2, wherein said washing machine is a vertical axis washer.

4. The method of claim 2, wherein said washing machine is a horizontal axis washer.

5. The method of claim 1, wherein said appliance is a clothes treating appliance and said material comprises a fabric load.

6. The method of claim 1, wherein said step of determining an amount of energy comprises rotating said vessel with an electric motor, measuring a current supplied to said motor, isolating a frequency of said current relating to said engagement of said vessel with said relatively stationary part and generating a curve representing said frequency, comparing said frequency with a curve representing a reference motor current, integrating areas above said reference curve within said engagement curve, and accumulating said areas for a predetermined time.

7. The method of claim 6, wherein said step of comparing comprises comparing said accumulated area value with a predetermined threshold value.

8. An appliance comprising:

a vessel mounted for rotation about an axis, configured to receive a supply of material and arranged relative to a relatively stationary part of said appliance whereby said vessel will engage said relatively stationary part in a severe unbalance loading condition of said material in said vessel while said vessel is rotating;

a control arranged and configured to rapidly accelerate a rotation of said vessel, determine an amount of energy with which said vessel has engaged said relatively stationary part, compare said amount of energy with a predetermined value, and send a signal indicative of an unbalance condition if said amount of energy exceeds said predetermined value.

9. An appliance according to claim 8, wherein said appliance is an automatic washing machine.

10. An appliance according to claim 9, wherein said washing machine is a vertical axis washer.

11. An appliance according to claim 9, wherein said washing machine is a horizontal axis washer.

12. An appliance according to claim 8, wherein said appliance is a clothes treating appliance and said material comprises a fabric load.

13. An appliance according to claim 8, including an electric motor drivingly connected to said rotatable vessel.

14. An appliance according to claim 13, wherein said electric motor comprises a controlled induction motor and an inverter is provided in the control connected to the motor, said control further comprising a current measuring device connected to a dc bus of said inverter.

15. An appliance according to claim 14, wherein said current measuring device provides an output signal representative of the current used by said motor, said control further including a digital filter connected to receive said output signal, said digital filter including a running average algorithm and providing an output representative of an average current used by said motor.

16. An appliance according to claim 8, wherein said signal comprises one of an audible and visible signal to a user.

17. An appliance according to claim 8, wherein said signal comprises an electrical signal transmitted to a further part of said control.

18. An appliance having a rotatable vessel configured to receive a supply of material mounted within a relatively stationary housing, said vessel rotatable about an axis and said vessel being mounted in a fashion such that it is movable relative to said housing in a direction perpendicular to said axis, comprising:

an electrical motor drivingly connected to said rotatable vessel, a control operatively connected to said motor and configured to rapidly accelerate a rotation of said vessel through operation of said motor, determine an amount of energy with which said vessel has engaged said relatively stationary part as reflected by a characteristic of electrical current drawn by said motor, compare said amount of energy with a predetermined value, and send a signal indicative of an unbalance condition if said amount of energy exceeds said predetermined value.

* * * * *